US006320551B1

(12) United States Patent
Kumar

(10) Patent No.: US 6,320,551 B1
(45) Date of Patent: Nov. 20, 2001

(54) ELECTRICAL APPARATUS

(75) Inventor: Balbir Kumar, Wembley (GB)

(73) Assignee: BAE Systems Electronics Limited (GB)

( * ) Notice: Subject to any disclaimer, the term of this patent is extended or adjusted under 35 U.S.C. 154(b) by 0 days.

(21) Appl. No.: 09/530,498

(22) PCT Filed: Oct. 26, 1998

(86) PCT No.: PCT/GB98/03187

§ 371 Date: May 18, 2000

§ 102(e) Date: May 18, 2000

(87) PCT Pub. No.: WO99/22424

PCT Pub. Date: May 6, 1999

(30) Foreign Application Priority Data

Oct. 29, 1997 (GB) ..... 9722720

(51) Int. Cl.[7] ..... H01Q 19/06; H01Q 1/00

(52) U.S. Cl. ..... 343/754; 343/787

(58) Field of Search ..... 343/787, 754, 343/753, 757, 909

(56) References Cited

U.S. PATENT DOCUMENTS

| | | | |
|---|---|---|---|
| 2,973,516 | 2/1961 | Medved | 343/754 |
| 3,369,242 | 2/1968 | Johnson | 343/754 |

FOREIGN PATENT DOCUMENTS

| | | | |
|---|---|---|---|
| 0 505 040 A1 | 9/1992 | (EP) | H01Q/3/44 |
| 2 253 947 A | 9/1992 | (GB) | H01Q/15/08 |
| WO 97/22158 | 6/1997 | (WO) | H01Q/19/06 |
| WO 84/01669 | 4/1984 | (WO) | H01Q/3/44 |

*Primary Examiner*—Don Wong
*Assistant Examiner*—Hoang Nguyen
(74) *Attorney, Agent, or Firm*—Kirschstein, et al.

(57) ABSTRACT

A beam steerer for steering a microwave beam comprises a body of magnetic material having an aperture and magnetic coils for applying a gradient of magnetization across the aperture. Tapered slots extending from the magnetic coils towards a central region of the aperture are filled with a material having a lower magnetic permeability than the magnetic material of the body. Lower reluctance paths available through the central region of the aperture allow more magnetic flux from the magnetic coils to penetrate through the central region than would be the case in a body of uniform material composition.

35 Claims, 2 Drawing Sheets

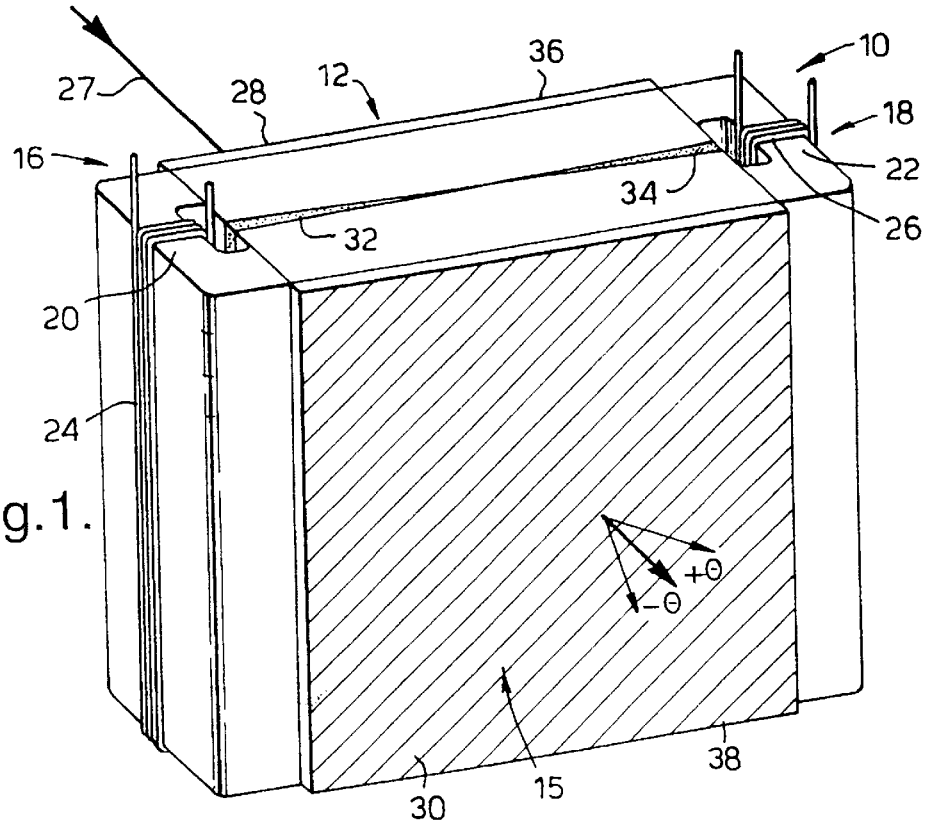
Fig.1.
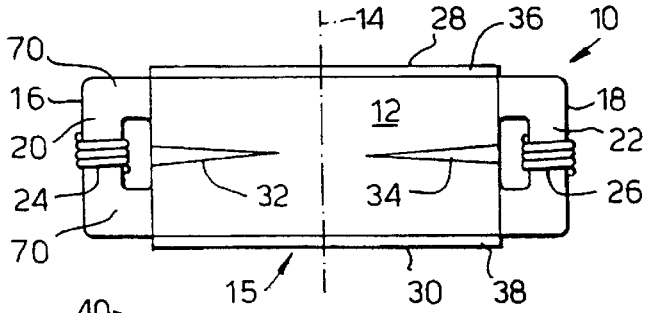
Fig.2.
Fig.3.
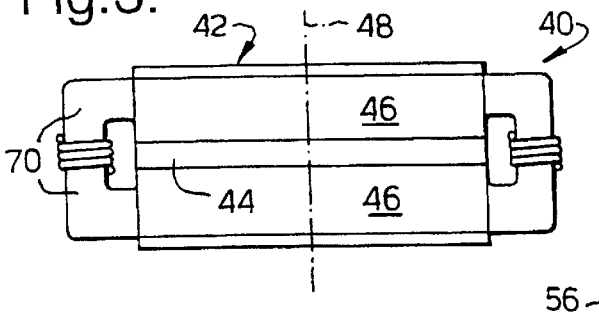
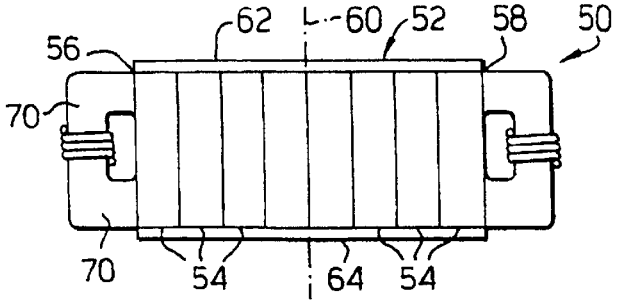
Fig.4.

ELECTRICAL APPARATUS

BACKGROUND OF THE INVENTION

This invention relates to a device which is adapted to be positioned in the path of a beam of electromagnetic radiation propagating in free space which changes characteristics of the beam. The invention is particularly, but not exclusively, concerned with microwave devices.

The term microwave refers to the part of the electromagnetic spectrum substantially in the frequency range 0.2 to 300 GHz. It includes that part of the spectrum referred to as millimeter wave (having a frequency in the range 30 to 300 GHz).

In a known device for controlling the direction of a microwave beam, the microwave beam passes through a rectangular block of dielectric material formed by two wedge-shaped pieces, one being of ferrite material and one being of non-ferrite material, the pieces having their sloping faces in juxtaposition. An external magnetic field is applied to the block in a direction perpendicular to the direction of propagation of the microwave beam. The magnetic field is substantially constant across the block.

Applied magnetic field induces magnetization in the material which is substantially uniform across the block. A microwave beam passing through the magnetised material will interact with it and this interaction changes relative velocity across the beam. If a microwave beam is directed through the block so as to travel in turn through a thickness of the ferrite and then through a thickness of the non-ferrite material, certain parts of the beam will travel through a different length of ferrite material compared to certain other parts of the beam thus causing a differential phase shift across the block. The phase at one edge will lag when compared to the phase at the other edge and the beam will be deflected. Altering the direction of the magnetic field will cause the beam to deflect in an opposite direction.

In another embodiment of a device for controlling the direction of a microwave beam, the beam passes through a cylinder of material formed by two wedge-shaped pieces one being of ferrite and one being of non-ferrite material, the pieces having the sloping faces in juxtaposition. The cylinder is located within an external solenoid which is used to apply a magnetic field along the longitudinal axis of the cylinder which is substantially parallel to the direction of propagation of the beam. The magnetic field is substantially constant across the cylinder. The device operates by Faraday rotation. For circularly polarized beams such a device induces a differential phase shift in the beam thus causing deflection of the beam. Linearly polarized beams are equivalent to a combination of two circularly polarized beams rotating in opposite directions and so such a device splits a linearly polarized beam into two separate circularly polarized beams leaving the device at angles $+\theta°$ and $-\theta°$ to the direction of propagation of the original beam.

Devices of this kind are difficult to construct and cause in-line loss due to beam reflection at the junction between the ferrite and non-ferrite wedge shaped pieces. Such devices provide beam deflection in one plane only and so two devices in series would be required to produce conical steering.

Another device for controlling the direction of a microwave beam comprises a body of ferrite material having magnetic coils which apply a magnetic field across the body which induces a gradient in magnetization across the body. The resultant direction of the beam leaving the device is perpendicular to the gradient in the magnetic field across the body. Therefore the degree of deflection in the beam is controlled by the gradient in the magnetization. The device differs from the two devices described above in that all parts across the width of a microwave beam pass through the same thickness of ferrite material. However magnetization induced varies across the ferrite material through which the microwave beam passes.

A disadvantage with this device is that the thickness of the body is governed by its width. If the body is relatively thin compared to its width, magnetic flux tends to concentrate around the coils and so does not penetrate sufficiently across the width of an aperture through which the beam passes and little or no magnetic flux passes through the body in a central region of the aperture. However, the width of the material is governed by the width of the beam which the device is to steer and so cannot be chosen independently. As a result devices of this type need to have a thickness and a width which are comparable. This causes the devices to be bulky, heavy, cumbersome and expensive. Furthermore a thicker material causes greater insertion loss in a system.

SUMMARY OF THE INVENTION

According to a first aspect the invention provides a device for controlling the direction of a beam of radiation comprising a body of magnetic material having an aperture for the beam of radiation and means for applying a gradient in magnetization across the aperture characterized in that there is a variation in material composition of the body such that a greater amount of magnetic field penetrates through a central region of the body than would be the case in a body of uniform material composition.

According to a second aspect of the invention provides a device for controlling the direction of beam of radiation comprising a body of magnetic material having an aperture for the beam of radiation and means for applying a gradient in magnetization across the aperture characterized in that across the aperture there is a variation in reluctance from a front face of the body through to a rear face of the body.

The aperture may be one of a plurality of sub-apertures which together form a complete single aperture of the device.

There may be a variation in reluctance and/or material composition in certain regions through the body and a lack of variation in certain other regions.

Preferably the beam of radiation is microwave radiation.

Preferably the body is of composite material. Preferably the material composition of the body varies from a front face of the aperture to a rear face of the aperture. The body may have a plurality of layers wherein the layers are perpendicular to the direction of propagation of the beam of radiation. At least one of the layers may extend from a first side of the aperture to a second opposite side. Alternatively, the material composition of the body may vary across the aperture from the first side to the opposite second side.

A magnetic material is one in which its internal magnetization is effected by magnetic field. Preferably the magnetic material is an electrical insulator. It may be a ferrite. Ferrite materials may be particularly suitable since they combine high permeability with low conductivity and low losses. Due to the low conductivity, ferrite materials are easily penetrated by microwaves.

Preferably the device comprises at least one magnetic field generating means. Preferably there are two magnetic field generating means. The magnetic field generating means may be a single wire or coils. Preferably the magnetic field generating means are provided in one or more pairs on opposite sides of the aperture. Preferably the or each pair of magnetic field generating means is adapted to produce lines of magnetic force in opposite directions to induce the gradient in magnetization. If the lines of magnetic force are in opposite directions on opposite sides of the beam, the resultant flux along the direction of propagation of the beam will be zero in the center of the aperture.

Preferably there are two gradients in magnetization which are in directions perpendicular to one another. This enables the direction of the beam to be controlled in azimuth as well as in elevation to achieve conical beam steering. In this event, pairs of coils would be located in proximity to faces of the body through which the beam of radiation does not pass. Preferably the gradient or gradients in the magnetization are substantially linear.

Conveniently the body comprises a first material containing at least one region of a second material having a magnetic permeability which is lower than the magnetic permeability of the first material. The or each region may extend from each magnetic field generating means. The or each region may extend towards the center of the aperture.

Preferably the or each region extends more than half the way to the midpoint between two magnetic field generating means. Most preferably the or each region extends about two thirds of the way to the midpoint between the magnetic field generating means.

Preferably the presence of the or each region having relatively lower permeability causes more of the magnetic flux to be deviated away from the magnetic field generating means and towards the center of the aperture than would be the case in the absence of the or each region.

Preferably the or each region comprises a slot in the first material containing the second material as an insert or as a filler. The or each slot may taper being thinner at an end nearest to the center of the aperture. The or each slot may have a linear taper or may have a curved taper. Alternatively the slot may have substantially uniform thickness. Such a slot having uniform thickness may extend all the way across the body from one side to another or may be a pair of slots which extend towards one another but not meet.

Conveniently the first material and the second material have dielectric permittivities which are matched. Preferably the dielectric permittivities as substantially equal.

In an embodiment in which the magnetic permeability of the first material is higher than the relative permeability of the second material, lines of magnetic force would encounter a magnetic discontinuity in the body and would be affected by it. However, if the dielectric permittivities of the first and second materials are substantially equal, propagation of the beam of radiation would not be substantially affected. The invention provides a way of affecting the magnetic circuit in the material whilst not affecting the performance of the device such as the transmission of microwaves.

BRIEF DESCRIPTION OF THE DRAWINGS

An embodiment of a microwave device in accordance with the invention will now be described, by way of example only, with reference to the accompanying figures in which:

FIG. 1 shows a perspective view of the device;

FIG. 2 shows a plan view from above of the device of FIG. 1;

FIG. 3 shows a plan view from above of an alternative embodiment of the device;

FIG. 4 shows a plan view from above of a further embodiment of the device;

DETAILED DESCRIPTION OF THE PREFERRED EMBODIMENTS

Figure 5:
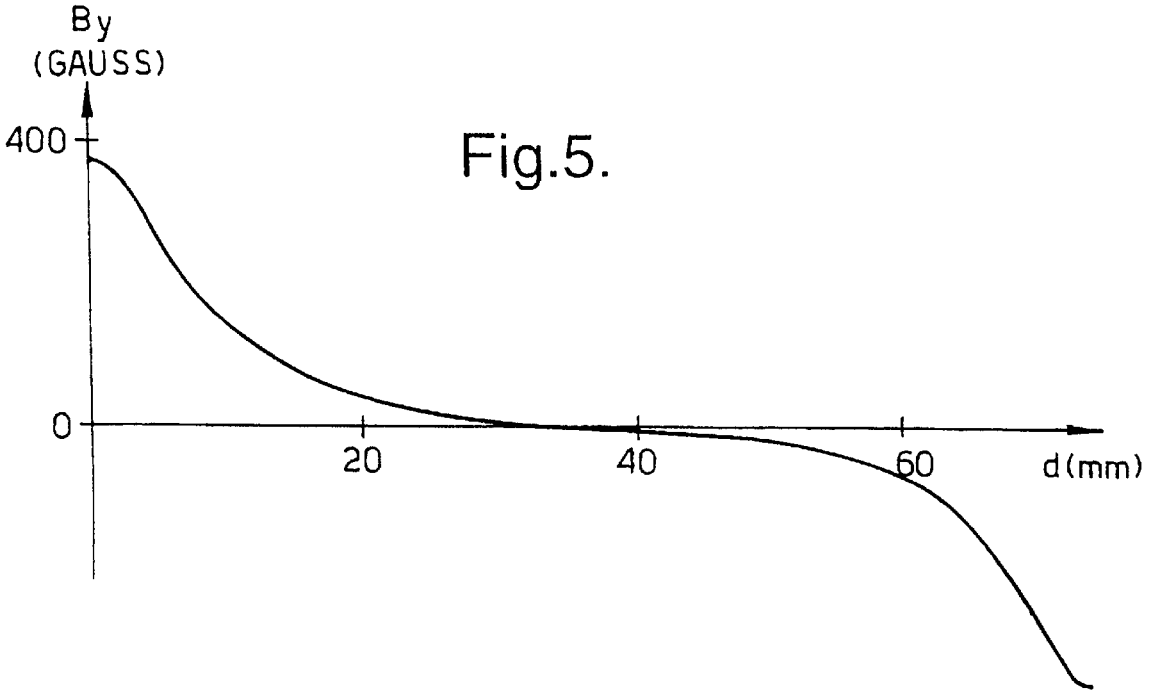
FIG. 5 shows a graph of magnetic flux density across the aperture of a prior art device.

A beam steering device 10 comprises a body 12 which is symmetrical about a central plane 14. At ends 16, 18 of the body 12 are separate end pieces 20, 22 which carry coils 24, 26. The coils 24, 26 have parallel axes which are orientated normal to a front face 28 and a rear face 30 of the body 12. A region of the body between the coils 24, 26, comprises an aperture 15 through which a microwave beam 27 may pass.

The end pieces 20, 22 are made of a material which is different to the material of the body of the device. They are of a material having a high magnetization such as mild steel or Swedish iron. Although they are usually uniform, they may be in the form of a laminated stack to reduce eddy currents. In fact, the body of the device may itself be in a laminated form. Alternatively the end pieces may be an integral part of the body 12.

The body 12 comprises ferrite material having a permeability which is dependent on magnetic field to which the body is subjected. A suitable ferrite material is TTI-3000 which is manufactured by Trans-tech Inc. Extending from ends 16, 18 towards the central plane 14 are tapered slots or gaps which are filled with dielectric inserts 32, 34 having a penmittivity identical to or similar to that of the ferrite material. A suitable material for the inserts is D13 manufactured by Trans-tech Inc. Although the permittivies of the ferrite material and the insert material are substantially the same, the magnetic permeability of the insert material is lower than that of the ferrite material. As a result the inserts 32, 34 present a relatively high reluctance path or barrier through the body 12 to magnetic field applied by the coils 24, 26. At a location near the coils the reluctance through the body 12 is relatively high compared to a body of uniform composition. The reluctance diminishes along the tapered inserts towards the central plane.

The subject matter of the end pieces being of a material different to that of the body of the device is an invention in its own right, distinct and independent from the subject matter of there being filled slots or gaps.

It is desirable to keep the body relatively thin with respect to its width. A thicker body increases weight, expense and difficulty of manufacture. It also increases in-line loss caused by use of the device 10. However, the thinner the body becomes, the more difficulty is experienced by lines of magnetic force in penetrating towards the central plane 14 and they tend to bunch around the coils. To counter-act this bunching effect, the inserts 32, 34 are provided in the body 12. Ideally the permeability of the inserts is unity although it may be higher. All that is required is that the permeability of the inserts is less than the permeability of the ferrite material of the body. The high reluctance paths provided by the insert material present a reluctance to the magnetic flux and the lines of magnetic force shift along the tapered inserts away from the coils to a narrower part of the insert or to a region of the aperture 15 free of inserts 32, 34.

Consequently the slots force the lines of magnetic force further inward towards the central plane 14 than would be the case in an unslotted device and a more controlled and uniform gradient in magnetic flux across the aperture is obtained. Therefore a more controlled and uniform gradient in magnetization across the aperture is obtained.

The length of the slots is dependent upon the width of the device, although as a guide each slot should extend from its respective coil about a third of the distance between the coils. In the embodiment discussed above in relation to FIGS. 1 and 2 the device has a body having an aperture of dimensions 75 mm×75 mm. The body has a thickness of about 25 mm. The slots are approximately 30 mm long and taper down from 1.0 mm to zero. The taper of the slots may be numerically calculated to give necessary thicknesses of taper along its length in order to provide a desired gradient of magnetic flux density across the aperture of the device.

The reluctance of the body across its thickness where the slots are not present may be about $9\times10^{-4}H^{-1}$. The reluctance of the body across its thickness where a dielectric material insert of 0.1 mm thickness (having a permeability of unity) is present may be about $13\times10^{-4}H^{-1}$.

The dielectric inserts are sufficiently thin so as not to degrade the microwave performance of the device 10.

In use of the device the coils 24, 26 are energised by a current source so that the magnetic field produced by the coils in the block is in a direction generally normal to faces 28, 30 of the block.

The magnetic field produced by coil 24 is in an opposite direction the magnetic field produced by the coil 26. There is zero magnetic field across the central plane 14 if the coils are energized equally.

The microwave beam 27 is of circularly polarized microwave energy and is directed centrally onto the face 28 of the device 10 in a direction normal to that face by means of a suitable lens arrangement such as a dielectric lens. The beam emerges undeviated from the face 30 if no current is flowing in the coils.

When a current flows through the coils the beam emerges from the device 10 in a direction at an angle θ° to the central plane 14. The deflection of the beam arizes as a result of differential phase shift across the beam along a line drawn between the coils. This differential phase shift is caused by the gradient in magnetization across the aperture induced by applied magnetic field. Magnetic field between the central plane 14 and the end 16 is in a first direction and magnetic field between the central plane 14 and the end 18 is in a second direction opposite to the first direction. Since the permeability of the ferrite depends on the direction and magnitude of the magnetic field, the phase shift experienced by the beam will vary across its width and the beam will be deflected. To deflect the beam in an opposite direction, the direction of current flow in the coils is reversed to switch the directions of the magnetic fields and have a corresponding effect on the magnetization. This results in the beam emerging from the device 10 in a direction at an angle −θ° to the central plane 14. If a linearly polarized beam is used, the device will have the effect of splitting such a beam into two beams (circularly polarized in opposite senses) one being at an angle θ° to the central plane 14 and the other being at an angle −θ° to the central plane 14. Therefore if the device 10 is used with a linearly polarized beam, it can be used as a power divider or in a twin beam scanning arrangement.

The degree of deflection is controlled by varying the current supplied to coils to alter the magnitude of the magnetic fields applied which alters magnetization and thus magnetization gradient in the material. A Gaussian beam of circular cross-section having a beam width of 30 mm and frequency 40 GHz may be deflected by the device 10 through about 25°.

The device is suitably matched to free space at its input and output ends by means of an anti-reflection coatings 36 and 38 of dielectric material on faces 28 and 30.

An alternative embodiment of the device is shown in FIG. 3. This shows a device 40 of similar basic structure to the device of FIGS. 1 and 2 which has a body 42 comprising a layer 44 of relatively low magnetic permeability material sandwiched between two layers 46 of higher magnetic permeability material. It is significant to note that unlike the device 10, the layer 44 is of uniform thickness and does not taper or have a gap in a central plane 48. However, even though magnetic permeability measured without the coils being energized from a front face of the body 42 to a rear face is constant across the aperture, inclusion of the layer 44 still has the effect of forcing lines of magnetic force further inward toward the central plane 48 than would be the case in a device having a body of uniform composition. A more uniform gradient in magnetization results. This embodiment is much simpler to fabricate than the embodiment of FIGS. 1 and 2.

A further embodiment of the device is shown in FIG. 4. This shows a device 50 which has a body 52 comprising a plurality of elongate elements 54 stacked together side by side. The magnetic preferabilities or saturation magnetizations of the elongate elements vary across the aperture such that they start at a relatively low value at each side 56, 58 of the body and increase to a higher value towards a central plane 60 of the body 52. This arrangement provides a gradient in magnetic permeability across the aperture (in a direction through the body, from a front face 62 to a rear face 64) having a form similar to that of FIGS. 1 and 2. Therefore, magnetic effects present in the device 50 are similar to those present in device 10.

It should be noted in FIGS. 1, 2, 3 and 4 that the construction is such that magnetic field generated by the coils is introduced into the body of each device through arm regions (see numeral 70 in FIGS. 2, 3 and 4). Consequently the magnetic field travels sideways into the body through its sides rather than through faces of the body. Sideways introduction of magnetic field is more efficient than introducing magnetic field through faces of the body. A complete internal magnetic circuit is achieved and no demagnetizing fields are induced.

FIG. 5 shows a graph of magnetic flux density B across the aperture of a prior art device. The device has an aperture having a width of about 75 mm. Therefore d=0 mm and d=75 mm represent the periphery of the aperture and d=37.5 mm represents the center of the aperture. There are two significant features to note. Firstly, the gradient of magnetic flux density in the center of the aperture (in the region where the magnetic flux density crosses the x-axis) is shallow. This means that the device will not deflect a beam strongly. Secondly, the gradient of magnetic flux density increases rapidly as the periphery of the aperture is approached. This graph represents the effect of magnetic flux concentrating around the coils.

Figure 6:
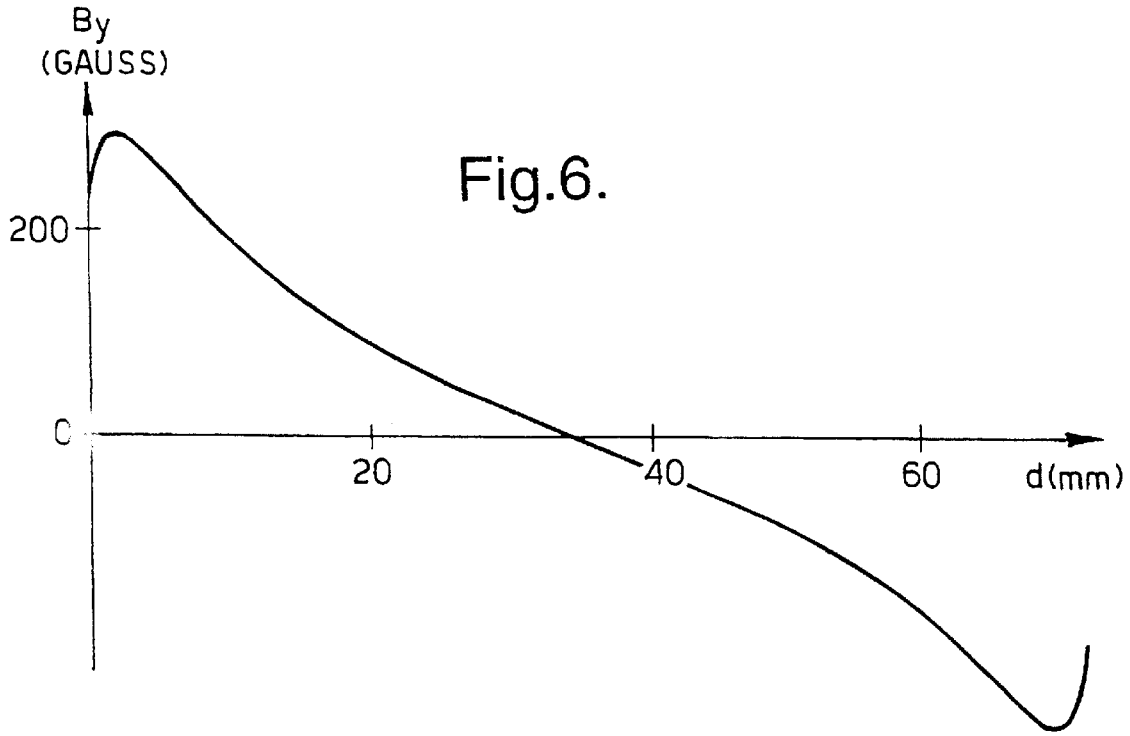
FIG. 6 shows a graph of magnetic flux density across the aperture of the device shown in FIGS. 1 and 2.

In comparison FIG. 6 shows a graph of magnetic flux density across the aperture of device 10. The effect of the inserts is clearly visible in that the gradient of magnetic flux density in the center of the aperture is higher than before and across the aperture the gradient is more constant.

These two effects provide stronger beam deflection and more spacial coherency in a deflected beam. The magnetic flux density shown in FIGS. 5 and 6 is from the edge of the body 12 adjacent to one coil 24, 26 to the edge of the body 12 adjacent to the other coil 24, 26 along a center line in the body.

It should be noted that the y-axis in these figures represents a value $B_y$. The magnetic flux density caused by the coils can be resolved into two components, $B_x$ and $B_y$. $B_y$ is that component of the magnetic flux density which causes Faraday rotation, that is the part which is parallel to the direction of propagation of a microwave beam.

It will be appreciated that the ferrite material chosen should exhibit low loss at the microwave frequencies concerned, satisfactory power handling capability, good temperature stability and a high value of saturation magnetization. The latter criterion is important in order that the largest possible maximum beam deflection is obtained.

One particular application envisaged for a device in accordance with the invention is in a rapidscanning antenna, for example in radar equipment, the device having the advantage over conventional antennae that no mechanical mechanism is involved. Alternatively, it may be used in a passive receiver for imaging and other applications. A further use for the device is as part of a transmitter and/or receiver in a communication system.

In general the device may find application in any equipment wherein a quasi-optical transmission of microwave waves between components of the system is employed.

What is claimed is:

1. A device for receiving a first beam of microwave radiation and controlling a direction of a corresponding second beam of microwave radiation that is output from the device, the second beam being derived from the first beam, the device comprising:

a) a body for receiving the first beam and for outputting the second beam;

b) magnetizing means for applying a magnetic field across the body to direct the first beam through the body to provide the second beam; and c) said body being fabricated to exhibit a spatially non-uniform magnetic reluctance, for directing a greater proportion of the magnetic field to penetrate through a central region of the body compared to a case where the body is fabricated from a material providing the body with a spatially uniform magnetic reluctance.

2. The device according to claim 1, wherein the body is of a material composition which spatially varies from a first region of the body where the first beam is received in operation, to a second region of the body where the second beam is output in operation.

3. The device according to claim 2, wherein the body comprises a plurality of layers having major faces disposed in operation to be substantially perpendicular to a direction of propagation of the first beam through the body.

4. The device according to claim 3, wherein at least one of the layers extends from the first region to the second region.

5. The device according to claim 3, wherein the body is of a material composition which spatially varies in a direction substantially perpendicular to the direction of propagation of the first beam through the body in operation.

6. The device according to claim 1, wherein the magnetizing means is operable in cooperation with the body to cause the magnetic field to have a spatial magnetic gradient which is more linear compared to the case where the body is fabricated from the material exhibiting the spatially uniform magnetic reluctance.

7. The device according to claim wherein the body comprises a first body region fabricated from a first material at least partially enclosing at least one body region fabricated from a second material having a magnetic permeability which is lower than a magnetic permeability of the first material.

8. A device for receiving a first beam of microwave radiation and controlling a direction of a corresponding second beam of microwave radiation that is output from the device, the second beam being derived from the first beam, the device comprising:

a) a body for receiving the first beam and for outputting the second beam, said body being of a material composition which spatially varies from a first region of the body where the first beam is received in operation, to a second region of the body where the second beam is output in operation;

b) magnetizing means for applying a magnetic field across the body to direct the first beam through the body to provide the second beam; and c) said body being fabricated to exhibit a spatially non-uniform magnetic reluctance, for directing a greater proportion of the magnetic field to penetrate through a central region of the body compared to a case where the body is fabricated from a material providing the body with a spatially uniform magnetic reluctance, said body comprising a plurality of layers having major faces disposed in operation to be substantially perpendicular to a direction of propagation of the first beam through the body, wherein at least one of the layers extends from the first region to the second region.

9. The device according to claim 8, wherein the body comprises first and second materials which exhibit dielectric permittivities which are substantially identical.

10. The device according to claim 8, wherein the magnetizing means comprises two assemblies on mutually opposite sides of the body, the assemblies incorporating coils on members magnetically coupled to the body, the members being of a mutually different material to that of the body.

11. The device according to claim 10, wherein the members are fabricated from metal.

12. The device according to claim 8, wherein the body is fabricated from a ferrite material.

13. The device according to claim 8, wherein the magnetizing means comprises at least one magnetizing assembly for applying the magnetic field across the body.

14. The device according to claim 13, wherein the magnetizing means comprises two magnetizing assemblies.

15. The device according to claim 8, wherein the magnetizing means is spatially distributed on mutually opposite sides of the body.

16. A device for receiving a first beam of microwave radiation and controlling a direction of a corresponding second beam of microwave radiation that is output from the device, the second beam being derived from the first beam, the device comprising:

a) a body for receiving the first beam and for outputting the second beam, said body being of a material composition which spatially varies from a first region of the body where the first beam is received in operation, to a second region of the body where the second beam is output in operation, and comprising a plurality of layers having major faces disposed in operation to be substantially perpendicular to a direction of propagation of the first beam through the body, said material composition spatially varying in a direction substantially perpendicular to the direction of propagation of the first beam through the body;

b) magnetizing means for applying a magnetic field across the body to direct the first beam through the body to provide the second beam; and c) said body being fabricated to exhibit a spatially non-uniform magnetic reluctance, for directing a greater proportion of the magnetic field to penetrate through a central region of the body compared to a case where the body is fabricated from a material providing the body with a spatially uniform magnetic reluctance.

17. The device according to claim 16, wherein the body is fabricated from a ferrite material.

18. The device according to claim 16, wherein the magnetizing means comprises at least one magnetizing assembly for applying the magnetic field across the body.

19. The device according to claim 18, wherein the magnetizing means comprises two magnetizing assemblies.

20. The device according to claim 16, wherein the magnetizing means is spatially distributed on mutually opposite sides of the body.

21. The device according to claim 16, wherein the body comprises first and second materials which exhibit dielectric permittivities which are substantially identical.

22. The device according to claim 16, wherein the magnetizing means comprises two assemblies on mutually opposite sides of the body, the assemblies incorporating coils on members magnetically coupled to the body, the members being of a mutually different material to that of the body.

23. The device according to claim 22, wherein the members are fabricated from metal.

24. A device for receiving a first beam of microwave radiation and controlling a direction of a corresponding second beam of microwave radiation that is output from the device, the second beam being derived from the first beam, the device comprising:

a) a body for receiving the first beam and for outputting the second beam;

b) magnetizing means for applying a magnetic field across the body to direct the first beam through the body to provide the second beam; and c) said body being fabricated to exhibit a spatially non-uniform magnetic reluctance, for directing a greater proportion of the magnetic field to penetrate through a central region of the body compared to a case where the body is fabricated from a material providing the body with a spatially uniform magnetic reluctance, wherein the magnetizing means is operable in cooperation with the body to cause the magnetic field to have a spatial magnetic gradient which is more linear compared to the case where the body is fabricated from the material exhibiting the spatially uniform magnetic reluctance.

25. The device according to claim 24, wherein the body comprises first and second materials which exhibit dielectric permittivities which are substantially identical.

26. The device according to claim 24, wherein the magnetizing means comprises two assemblies on mutually opposite sides of the body, the assemblies incorporating coils on members magnetically coupled to the body, the members being of a mutually different material to that of the body.

27. The device according to claim 26, wherein the members are fabricated from metal.

28. A device for receiving a first beam of microwave radiation and controlling a direction of a corresponding second beam of microwave radiation that is output from the device, the second beam being derived from the first beam, the device comprising:

a) a body for receiving the first beam and for outputting the second beam;

b) magnetizing means for applying a magnetic field across the body to direct the first beam through the body to provide the second beam; and c) said body being fabricated to exhibit a spatially non-uniform magnetic reluctance, for directing a greater proportion of the magnetic field to penetrate through a central region of the body compared to a case where the body is fabricated from a material providing the body with a spatially uniform magnetic reluctance, wherein the body comprises a first body region fabricated from a first material at least partially enclosing at least one body region fabricated from a second material having a magnetic permeability which is lower than a magnetic permeability of the first material.

29. The device according to claim 28, wherein each body region extends from one assembly of the magnetizing means to at least one other assembly of said magnetizing means.

30. The device according to claim 28, wherein the magnetizing means incorporates two magnetizing assemblies, and each body region extends more than half a distance from a midpoint between the two assemblies to the assemblies.

31. The device according to claim 28, wherein said at least one body region is fabricated from the second material and is in a form of a slot in the first body region, said first body region being fabricated from the first material.

32. The device according to claim 31, wherein the slot is tapered to thin towards the central region.

33. The device according to claim 28, wherein the first and second materials exhibit dielectric permittivities which are substantially identical.

34. The device according to claim 28, wherein the magnetizing means comprises two assemblies on mutually opposite sides of the body, the assemblies incorporating coils on members magnetically coupled to the body, the members being of a mutually different material to that of the body.

35. The device according to claim 34, wherein the members are fabricated from metal.

* * * * *